US007328878B2

(12) United States Patent
Ross

(10) Patent No.: US 7,328,878 B2
(45) Date of Patent: Feb. 12, 2008

(54) BOOK HOLDER HAVING A CENTRAL GAP IN A TRANSPARENT FRONT PANEL FOR TURNING PAGES WHICH ARE MAGNETICALLY SECURED TO THE FRONT PANEL

(76) Inventor: Michael D. Ross, 644 E. 500 South, Provo, UT (US) 84606

( * ) Notice: Subject to any disclaimer, the term of this patent is extended or adjusted under 35 U.S.C. 154(b) by 0 days.

(21) Appl. No.: 11/548,662

(22) Filed: Oct. 11, 2006

(65) Prior Publication Data

US 2007/0131836 A1 Jun. 14, 2007

Related U.S. Application Data

(60) Provisional application No. 60/725,543, filed on Oct. 11, 2005.

(51) Int. Cl.
*A47B 23/00* (2006.01)

(52) U.S. Cl. ..... 248/444.1

(58) Field of Classification Search ..... 248/441.1, 248/444.1, 450, 451, 452; 281/45; 294/137
See application file for complete search history.

(56) References Cited

U.S. PATENT DOCUMENTS 2,497,332 A * 2/1950 Teetor ..... 281/45
3,833,197 A * 9/1974 Dyke ..... 248/441.1
4,470,571 A * 9/1984 Hartman ..... 248/452
4,512,603 A * 4/1985 Williams ..... 294/137
6,019,339 A * 2/2000 Brayford ..... 248/444.1
2005/0035588 A1* 2/2005 Rickards ..... 281/45
2005/0230592 A1* 10/2005 Tillinghast et al. ..... 248/441.1
2006/0016951 A1* 1/2006 Nash et al. ..... 248/441.1
2006/0278779 A1* 12/2006 Killion ..... 248/206.5

* cited by examiner

*Primary Examiner*—Ramon O Ramirez
(74) *Attorney, Agent, or Firm*—Angus C. Fox, III

(57) ABSTRACT

A book holder includes a generally rigid rear panel, generally rigid, spaced-apart front panels that are at least partially transparent, generally parallel to and rigidly coupled to the rear panel, a ferromagnetic strip attached to a lower exterior portion of each front panel, and a plurality of magnetic clips, each of which may be attached to a page of a book which must be turned. The covers of a book and pages thereof which need not be turned, may be placed between the front and rear panels. The space between the two front panels permits the pages which must be turned to be secured to either ferromagnetic strip. The holder may optionally include, beneath the front panels, a tubular base portion, equipped with a finger slot at each end to facilitate grasping the magnetic clips and turning the pages.

20 Claims, 4 Drawing Sheets

BOOK HOLDER HAVING A CENTRAL GAP IN A TRANSPARENT FRONT PANEL FOR TURNING PAGES WHICH ARE MAGNETICALLY SECURED TO THE FRONT PANEL

This application has a priority date based on provisional patent application No. 60/725,543, which was filed on Oct. 11, 2005.

BACKGROUND OF THE INVENTION

1. Field of the Invention

This invention relates to book holders and, more particularly, to book holders which combine multiple modes of page retention capability.

2. Description of the Prior Art

Motivation to develop the present invention arose from the lack of adequate music holders. On a piano, for example, a pianists typically hold each side of a new music book with another book. Even using this technique, a new book will still have a tendency to pull itself away from the anchoring books and slam itself shut. Turning the pages of a book so retained is particularly difficult and can result in a major interruption of the performance as a piece of music is being played.

The problem has been addressed for the use of cook books in the kitchen. A book holder has been developed that retains a book between two generally parallel, transparent panes of acrylic plastic, which both protect the pages of the book and prevent the pages from turning. Such a book holder, however, does not lend itself to use as a music book holder, as turning pages of the book is particularly cumbersome, as the book must be removed from the holder, the page turned and the book reinserted within the holder.

What is needed is a book holder that not only maintains the book in an open configuration, but also permits certain pages of the book to also be retained and be turned one page at a time.

SUMMARY OF THE INVENTION

The book holder of the present invention, which fulfills the heretofore expressed need, includes a generally rigid rear panel, generally rigid, a front panel having a central gap that is generally parallel to the rear panel, and rigidly coupled thereto, a permanent magnetic strip attached to left and right lower exterior portions of the front panel, and a plurality of ferromagnetic clips, each of which may be attached to a page of a book which must be turned during, for example, a performance and secured to either magnetic strip. The covers of a book to be held and pages of the book which need not be turned during the performance, may be placed between the front and rear panels. The space between the two front panels permits the pages which must be turned to be secured, first to the magnetic strip on the right panel and, subsequently, to the magnetic strip on the left panel as it is turned. The book holder is particularly useful for music books, which normally do not have a loose-leaf or spiral binding, and which remain in an open configuration only reluctantly, unless the binding has been broken. The book holder may optionally include a tubular base portion beneath the front panels, which is equipped with a finger slot at each end to facilitate grasping the magnetic clips and turning the pages of a book.

DETAILED DESCRIPTION OF THE INVENTION

Figure 1:
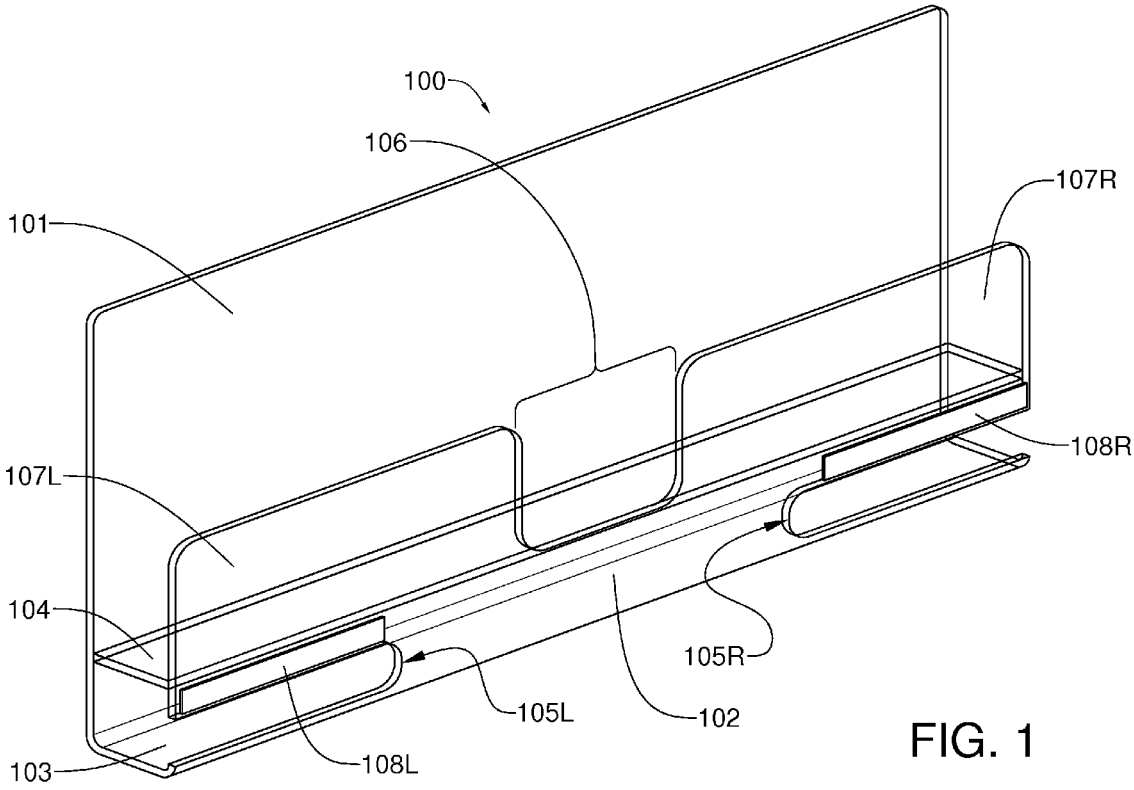
FIG. 1 is an isometric view of a first embodiment of the new book holder.

Referring now to FIG. 1, a first embodiment 100 of the new book holder includes single piece of generally rigid, laminar transparent polymeric material that is heated and then bent in a generally U-shaped configuration to form a rear panel 101, a front panel 102, and a connecting lower panel 103. A book support panel 104 spans the gap between the rear panel 101 and the front panel 102, being adhesively bonded to both panels. The front panel 102 has a pair of spaced-apart, opposed, U-shaped slotted cutouts 105L and 105R, which facilitate the turning of pages of a book that is installed in the holder. The front panel has a central gap 106 between a left upper panel portion 107L and a right upper panel portion 107R. The central gap 106 permits certain selected pages of an installed book to be secured to the outer surface of the front panel, thereby enabling and facilitating the turning of the selected pages. A left permanent magnetic strip 108L is positioned above the left U-shaped cutout 105L and permanently secured to the outer surface of the front panel 102, and a right permanent magnetic strip 108R is positioned above the right U-shaped cutout 105R and permanently secured to the outer surface of the front panel 102. The right magnetic strip 108R permits selected pages to be magnetically secured to the outer surface of the right upper panel portion 107R, while the left magnetic strip 108L permits selected pages to be magnetically secured to the outer surface of the left upper panel portion 107L. For a preferred embodiment of the invention, the rear panel 101, the front panel 102 and the lower panel 103 are formed from a single sheet of transparent acrylic plastic. The book support panel 104 is also fabricated from an acrylic plastic sheet. It should be evident that the portion of the front panel 102 above the book support panel 104 must be transparent so that pages behind it can be read.

Figure 2:
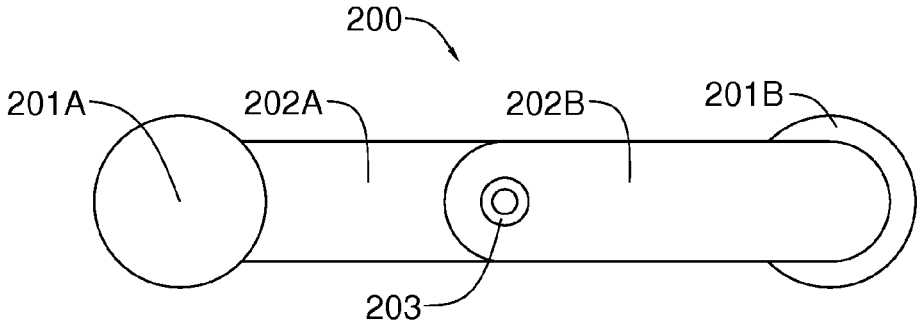
FIG. 2 is a top plan view of a fully open magnetic clip.

Referring now to FIG. 2, a ferromagnetic clip 200 is shown in a fully open position. The clip 200 includes a pair of disk-shaped permanent magnets 201A and 201B, a first laminar strip 202A made preferably of spring steel metal attached to magnet 201A and a second laminar strip 202B, identical to the first, attached to magnet 201B. The two laminar tabs 202A and 202B are pivotally attached with a rivet 203.

Figure 3:
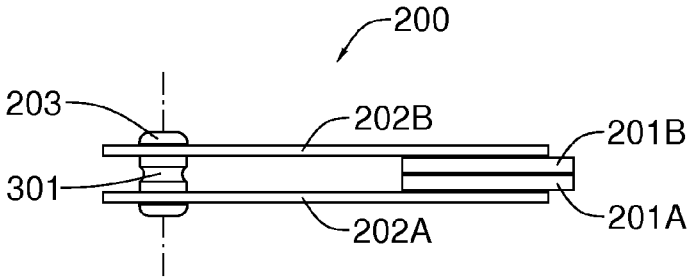
FIG. 3 is a side elevational view of a fully closed magnetic clip.

Referring now to FIG. 3, a spacer 301 maintains the first and second laminars strips 202A and 202B in a spaced-apart relationship. The rivet 203 is coaxial with the spacer 301. The magnets 201A and 201B are in contact with one another in preferably a North-to-South pole arrangement so that they strongly attract one another.

Figure 4:
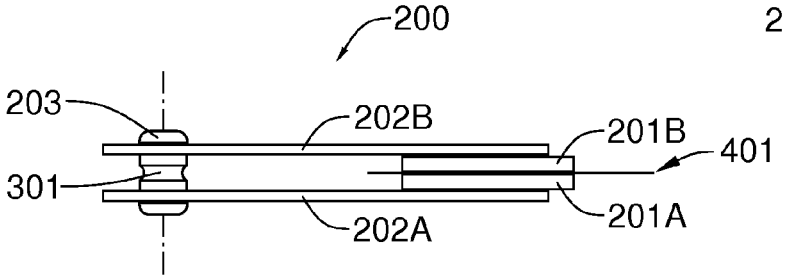
FIG. 4 is a side elevational view of a magnetic clip, fully closed over a sheet of paper.

Referring now to FIG. 4, a sheet of paper has been placed between the magents 201A and 201B of the ferromagnetic clip 200.

Figure 5:
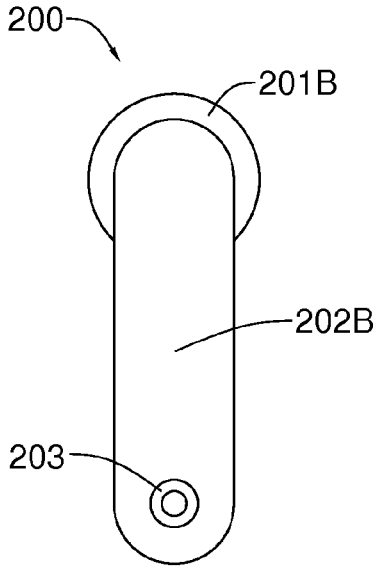
FIG. 5 is a top plan view of the fully closed magnetic tip.

Referring now to FIG. 5, the ferromagnetic clip 200 is shown in a fully closed configuration, the first and second tabs 202A and 202B, respectively, having been pivoted about the rivet axis 501 so that they and the magnets 201A and 201B are superimposed on each other.

Figure 6:
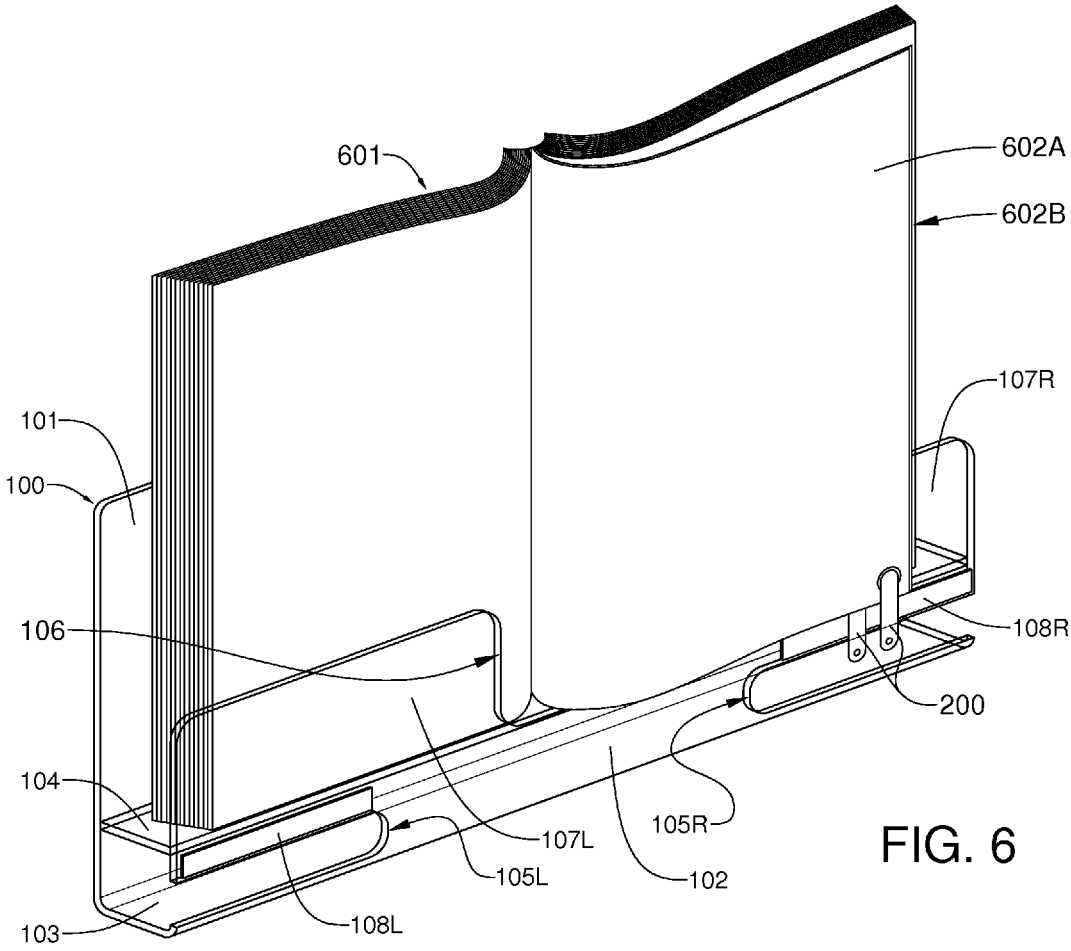
FIG. 6 is an isometric view of the first embodiment book holder and a book installed therein.

Referring now to FIG. 6, a book 601 has been placed within the first embodiment book holder 100 so that it is between the front and rear panels 102 and 101, respectively. Two selected pages 602A and 602B pass through the central gap 106 and each is secured with a magnetic clip 200 to the right magnetic strip 108R. When page 602A is turned, a user grasps the ferromagnetic clip 200 attached to that page, releases one side of the clip 200 from the right magnetic strip 108R, turns the page 602A to the other side and attaches the opposite side of the same ferromagnetic clip 200 to the left magnetic strip 108L. Page 602B may be turned in a like manner. It will be noted that the U-shaped cutouts 105L and 105R facilitate the grasping of the ferromagnetic clip 200 and releasing it from a magnetic strip 108L or 108R.

Figure 7:
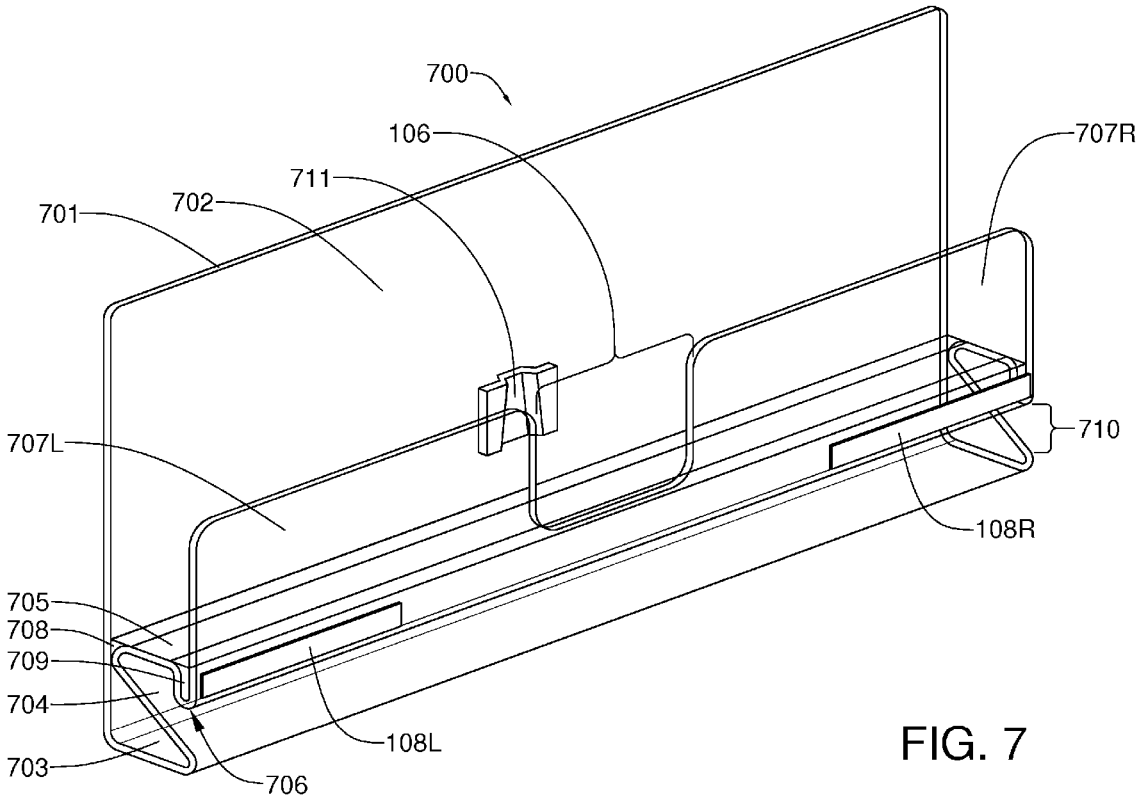
FIG. 7 is an alternative, second embodiment of the new book holder.

Referring now to FIG. 7, for a second embodiment 700 of the new book holder, a single laminar transparent polymeric panel 701 is formed using heat to provide a rear panel 702, a bottom panel 703, a diagonal connection panel 704, a book support panel 705, a U-shaped downward extension 706, and a front panel which includes a left portion 707L and a right portion 707R separated by a central gap 106. The U-shaped cutouts 105L and 105R of the first embodiment book holder 100 are replaced by a continuous recess 710, which spans the length of the second embodiment book holder 700. A bead or strip 708 of resilient material, such as clear room-temperature-vulcanizing (RTV) silicone rubber, may be used to join the book support platform 704 to the rear panel 701. The U-shaped downward extension 706 may also be filled with a similar compound to prevent pages of a book or multiple-page sheet music from being caught therein. Functionally, the second embodiment book holder 700 functions identically to the first embodiment book holder 100.

Either embodiment of the book holder 100 or 700 may be used as a free-standing book holder for example, by leaning it against the music rest of a piano, or it may be used as the music support portion of a self-supporting music stand. A bracket 711, which fits into an upper end of the base of the self-supporting music stand, may be bonded, riveted, or otherwise attached to the backside of the rear panel 101 or 701.

The laminar polymeric material either embodiment of the book holder 100 or 700 may be fabricated from a polymeric plastic material such as Polymethylmethacrylate (Acrylic), Polycarbonate, Polystyrene, MBS Polymethacrylate Butadiene Styrene (MBS), Styrene Acrylonitrile Copolymer, Cellulose Acetate Propionate (CP), or any other durable, transparent, semi-rigid polymeric material.

Although only several embodiments of the invention has been shown and described, it will be obvious to those having ordinary skill in the art that changes and modifications may be made thereto without departing from the scope and the spirit of the invention as hereinafter claimed.

What is claimed is:

1. A book holder comprising:

a generally rigid laminar rear panel;

a generally rigid laminar transparent front panel having a central gap through which selected pages of a book, held in an open position between said front and rear panels, may extend;

a generally rigid laminar book support panel coupled and generally perpendicular to both said rear panel and said front panel;

a generally rigid laminar bottom panel coupled to both said rear panel and said front panel, said bottom panel being generally parallel to said book support panel;

at least one magnetic strip affixed to said front panel below an upper surface of said book support panel, said at least one magnetic strip having portions positioned to the left and to the right of said central gap; and a plurality of ferromagnetic clips, each of which is attachable to a lower portion of a selected page, each selected page and an attached clip being alternately securable to both left and right portions of said at least one magnetic strip.

2. The book holder of claim 1, wherein said rear panel, said bottom panel and said front panel are formed from a bent, single piece of laminar generally transparent polymeric material.

3. The book holder of claim 2, which further comprises left and right slotted cutouts beneath said at least one magnetic strip, said left cutout extending to a left edge of said front panel, and said right cutout extending to a right edge of said front panel.

4. The book holder of claim 1, wherein said rear panel, said bottom panel, said book support panel and said front panel are formed from a bent, single piece of laminar, generally transparent polymeric material.

5. The book holder of claim 4, wherein said single piece of laminar, generally transparent polymeric material is bent in such a manner that a longitudinal recess extends an entire length of the book holder between the bottom and front panels.

6. The book holder of claim 1, wherein a flexible adhesive is used to fill gaps on the upper surface of the book support panel.

7. The book holder of claim 1, wherein each of said ferromagnetic clips comprises:

a pair of laminar strips having first and second ends, said first ends thereof being pivotally joined; and a pair of permanent magnet disks, each of which is attached to a second end of a laminar strip so that both magnet disks are in contact with one another in a North-to-South pole arrangement, said laminar strips having sufficient flexibility that the magnet disks can be separated to insert a page therebetween.

8. The book holder of claim 7, wherein a first laminar strip of a ferromagnetic clip may be attached to said at least one magnetic strip when a page is secured to a right side of the book holder, and a second laminar strip of the ferromagnetic clip may be attached to said at least one magnetic strip after the page is turned and secured to a left side of the book holder.

9. The book holder of claim 1, wherein said central gap extends from an upper edge of said front panel to at least an upper surface of said book support panel.

10. The book holder of claim 1, wherein said rear, bottom, book support and front panels are fabricated from a polymeric plastic material selected from the group consisting of polymethylmethacrylate, polycarbonate, polystyrene, polymethacrylate butadiene styrene, styrene acrylonitrile copolymer, cellulose acetate propionate.

11. A book holder comprising:

generally rigid, mutually parallel, spaced-apart front and rear panels, said front panel being generally transparent and having a central gap through which selected pages of a book, held in an open position between said front and rear panels, may extend;

generally rigid, mutually parallel, spaced-apart bottom and book-support panels, each of which is coupled to both said front and rear panels;

first and second magnetic strips, said first magnetic strip being secured to said front panel and positioned below said book-support panel to the left of said central gap, and said second magnetic strip being secured to said front panel and positioned below said book-support panel to the right of said central gap; and a plurality of ferromagnetic clips attachable to a lower portion of a selected page, said selected page and attached clip being alternately securable to either said first or said second magnetic strip.

12. The book holder of claim 11, wherein said rear panel, said bottom panel and said front panel are formed from a bent, single piece of laminar generally transparent polymeric material.

13. The book holder of claim 12, which further comprises left and right slotted cutouts beneath said at least one magnetic strip, said left cutout extending to a left edge of said front panel, and said right cutout extending to a right edge of said front panel.

14. The book holder of claim 11, wherein said rear panel, said bottom panel, said book support panel and said front panel are formed from a bent, single piece of laminar, generally transparent polymeric material.

15. The book holder of claim 14, wherein said single piece of laminar, generally transparent polymeric material is bent in such a manner that a longitudinal recess extends an entire length of the book holder between the bottom and front panels.

16. The book holder of claim 11, wherein a flexible adhesive is used to fill gaps on the upper surface of the book support panel.

17. The book holder of claim 11, wherein each of said ferromagnetic clips comprises:

a pair of laminar strips having first and second ends, said first ends thereof being pivotally joined; and a pair of permanent magnet disks, each of which is attached to a second end of a laminar strip so that both magnet disks are in contact with one another in a North-to-South pole arrangement, said laminar strips having sufficient flexibility that the magnet disks can be separated to insert a page therebetween.

18. The book holder of claim 17, wherein a first laminar strip of a ferromagnetic clip may be attached to said at least one magnetic strip when a page is secured to a right side of the book holder, and a second laminar strip of the ferromagnetic clip may be attached to said at least one magnetic strip after the page is turned and secured to a left side of the book holder.

19. The book holder of claim 11, wherein said central gap extends from an upper edge of said front panel to at least an upper surface of said book support panel.

20. The book holder of claim 11, wherein said rear, bottom, book support and front panels are fabricated from a polymeric plastic material selected from the group consisting of polymethylmethacrylate, polycarbonate, polystyrene, polymethacrylate butadiene styrene, styrene acrylonitrile copolymer, cellulose acetate propionate.

* * * * *